US011282438B2

(12) United States Patent
Kang et al.

(10) Patent No.: US 11,282,438 B2
(45) Date of Patent: Mar. 22, 2022

(54) DRIVER CIRCUIT AND A DISPLAY APPARATUS

(71) Applicant: Novatek Microelectronics Corp., Hsinchu (TW)

(72) Inventors: Chun-Wei Kang, Hsinchu (TW); Jhih-Siou Cheng, New Taipei (TW); Chun-Fu Lin, Taoyuan (TW); Po-Hsiang Fang, Hsinchu County (TW); Ju-Lin Huang, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/919,069

(22) Filed: Jul. 1, 2020

(65) Prior Publication Data

US 2021/0304661 A1 Sep. 30, 2021

Related U.S. Application Data

(60) Provisional application No. 63/001,531, filed on Mar. 30, 2020.

(51) Int. Cl.
*G09G 3/32* (2016.01)

(52) U.S. Cl.
CPC ..... *G09G 3/32* (2013.01); *G09G 2310/0267* (2013.01); *G09G 2310/0275* (2013.01)

(58) Field of Classification Search
CPC ..... G09G 3/32; G09G 3/3233; G09G 3/3241; G09G 3/3258; G09G 2310/0275; G09G 2310/0267
See application file for complete search history.

(56) References Cited

U.S. PATENT DOCUMENTS

| | | | | |
|---|---|---|---|---|
| 6,348,910 | B1 * | 2/2002 | Yamamoto | G09G 3/3629 345/102 |
| 9,412,304 | B2 * | 8/2016 | Park | G09G 3/3258 |
| 10,497,334 | B2 * | 12/2019 | So | G09G 3/20 |
| 2016/0189619 | A1 * | 6/2016 | Park | G09G 3/3258 345/690 |

* cited by examiner

*Primary Examiner* — Vijay Shankar
(74) *Attorney, Agent, or Firm* — JCIPRNET

(57) ABSTRACT

A driver circuit configured to receive a display data and drive a display panel is provided. The display panel includes a plurality of light-emitting diode devices according to the display data. The driver circuit includes a data driver. The data driver is configured to output driving signals to drive the light-emitting diode devices according to the display data and operate in different operation modes according to a control signal. The data driver includes a plurality of output channels. The output channels output the driving signals to drive the light-emitting diode devices via respective output terminals of the driver circuit. An assignment relationship of the display data and the output channels is different in the different operation modes. A display apparatus including the driver circuit is also provided.

17 Claims, 10 Drawing Sheets

DRIVER CIRCUIT AND A DISPLAY APPARATUS

CROSS-REFERENCE TO RELATED APPLICATION

This application claims the priority benefit of U.S. provisional application Ser. No. 63/001,531, filed on Mar. 30, 2020. The entirety of the above-mentioned patent application is hereby incorporated by reference herein and made a part of this specification.

BACKGROUND

Technical Field

The invention generally relates to a driver circuit and a display apparatus. More particularly, the invention relates to a driver circuit for driving a light emitting diode (LED) display panel and a display apparatus including the LED display panel.

Description of Related Art

In a LED display system, pulse-width modulation (PWM) is used in many applications to drive a plurality of LEDs on a display panel. A driver chip may be connected to the display panel via printed circuit boards (PCB) or wiring on glass to drive the LEDs. The driver chip sequentially outputs scan signals to scan LED lines of the display panel and outputs driving currents to drive respective LED columns of the display panel via chip pins. In the related art, if output pins of the driver chip are not consistent with the arrangement of the LEDs, the wiring structure between the driver chip and the display panel may include jumper wires and cross-layer wiring. The wiring structure between the driver chip and the display panel is complex.

SUMMARY

The invention is directed to a driver circuit and a display apparatus, in which the data assignment can be flexibly adjusted, and the wire structure between the driver circuit and the display panel is simple.

An embodiment of the invention provides a driver circuit configured to receive a display data and drive a display panel. The display panel includes a plurality of light-emitting diode devices according to the display data. The driver circuit includes a data driver. The data driver is configured to output driving signals to drive the light-emitting diode devices according to the display data and operate in different operation modes according to a control signal. The data driver includes a plurality of output channels. The output channels output the driving signals to drive the light-emitting diode devices via respective output terminals of the driver circuit. An assignment relationship of the display data and the output channels is different in the different operation modes.

In an embodiment of the invention, the output channels are grouped into a plurality of channel groups. The channel groups are disposed in different sides of the driver circuit.

In an embodiment of the invention, the channel groups include a first channel group. A specified channel number of the first channel group is activated to output the driving signals according to the control signal. The specified channel number is adjustable and equal to or smaller than a total channel number of the first channel group.

In an embodiment of the invention, the channel groups include a second channel group and a third channel group. A constant channel number of the second channel group and the third channel group is activated to output the driving signals. The constant channel number is equal to a total channel number of the second channel group and the third channel group.

In an embodiment of the invention, the display data includes a plurality of data segments. The data segments are assigned to the respective channel groups, and each of the data segments includes a plurality of pixel data. The pixel data is assigned to the channel group in a first sequence or in a second sequence according to the control signal. The first sequence and the second sequence are inverse sequences.

In an embodiment of the invention, the display data includes a plurality of data segments. The data segments are assigned to the respective channel groups, and each of the data segments includes a plurality of pixel data. The pixel data is assigned to the channel group in a first sequence or in a second sequence according to a first selection signal from an input terminal of the driver circuit. The first sequence and the second sequence are inverse sequences.

In an embodiment of the invention, the driver circuit further includes a storage circuit. The storage circuit is configured to store the assignment relationship of the display data and the output channels of the different operation modes.

In an embodiment of the invention, the driver circuit further includes a scan driver. The scan driver is configured to output scan signals to scan lines of the light-emitting diode devices in a third sequence or in a fourth sequence according to a second selection signal from an input terminal of the driver circuit. The third sequence and the fourth sequence are inverse sequences.

An embodiment of the invention provides a display apparatus including a display panel and a driver circuit. The display panel includes a plurality of data lines and a plurality of light-emitting diode devices connected to the data lines. The driver circuit is configured to receive a display data and drive the display panel according to the display data. The driver circuit includes a data driver. The data driver is configured to output driving signals to the data lines to drive the light-emitting diode devices according to the display data and operate in different operation modes according to a control signal. The data driver includes a plurality of output channels. The output channels output the driving signals to the data lines to drive the light-emitting diode devices via respective output terminals of the driver circuit. An assignment relationship of the display data and the output channels is different in the different operation modes.

In an embodiment of the invention, the output channels are grouped into a plurality of channel groups, and the channel groups are disposed in different sides of the driver circuit.

In an embodiment of the invention, the channel groups include a first channel group. A specified channel number of the first channel group is activated to output the driving signals according to the control signal. The specified channel number is adjustable and equal to or smaller than a total channel number of the first channel group.

In an embodiment of the invention, the channel groups include a second channel group and a third channel group. A constant channel number of the second channel group and the third channel group is activated to output the driving signals, and the constant channel number is equal to a total channel number of the second channel group and the third channel group.

In an embodiment of the invention, the display data includes a plurality of data segments. The data segments are assigned to the respective channel groups, and each of the data segments includes a plurality of pixel data. The pixel data is assigned to the channel group in a first sequence or in a second sequence according to the control signal, and the first sequence and the second sequence are inverse sequences.

In an embodiment of the invention, the display data includes a plurality of data segments. The data segments are assigned to the respective channel groups, and each of the data segments includes a plurality of pixel data. The pixel data is assigned to the channel group in a first sequence or in a second sequence according to a first selection signal from an input terminal of the driver circuit. The first sequence and the second sequence are inverse sequences.

In an embodiment of the invention, the driver circuit further includes a storage circuit. The storage circuit is configured to store the assignment relationship of the display data and the output channels of the different operation modes.

In an embodiment of the invention, the display panel further includes a plurality of scan lines connected to the light-emitting diode devices. The driver circuit further includes a scan driver. The scan driver is configured to output scan signals to the scan lines to scan lines of the light-emitting diode devices in a third sequence or in a fourth sequence according to a second selection signal from an input terminal of the driver circuit. The third sequence and the fourth sequence are inverse sequences.

In an embodiment of the invention, the display apparatus further includes a control circuit. The control circuit is configured to output the display data to the driver circuit and output the control signal to set the operation mode of the driver circuit.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
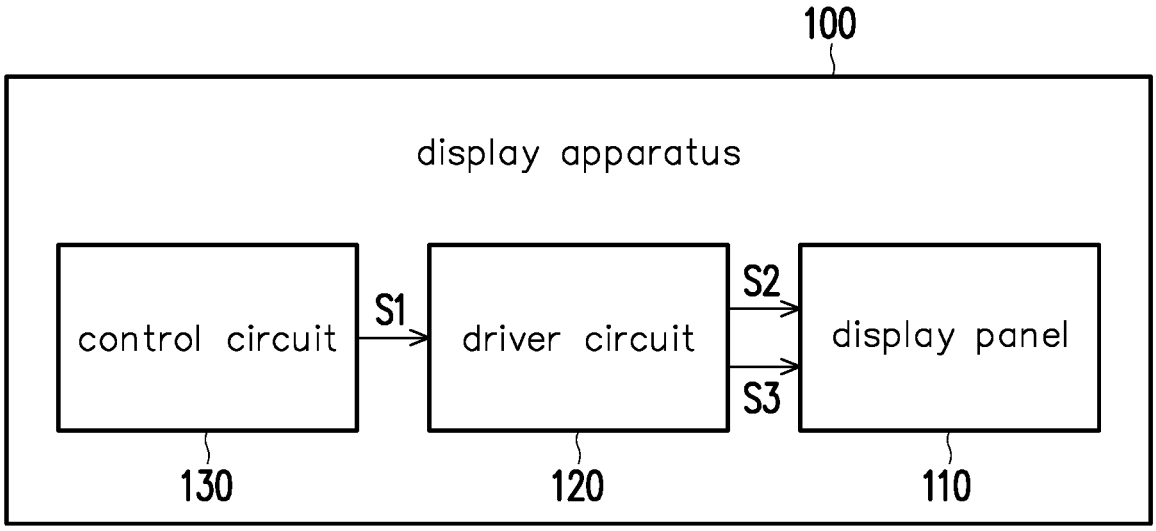
FIG. 1 illustrates a block diagram of a display apparatus according to an embodiment of the invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Embodiments are provided below to describe the disclosure in detail, though the disclosure is not limited to the provided embodiments, and the provided embodiments can be suitably combined. The term "coupling/coupled" used in this specification (including claims) of the application may refer to any direct or indirect connection means. For example, "a first device is coupled to a second device" should be interpreted as "the first device is directly connected to the second device" or "the first device is indirectly connected to the second device through other devices or connection means." In addition, the term "signal" can refer to a current, a voltage, a charge, a temperature, data, electromagnetic wave or any one or multiple signals.

Figure 2:
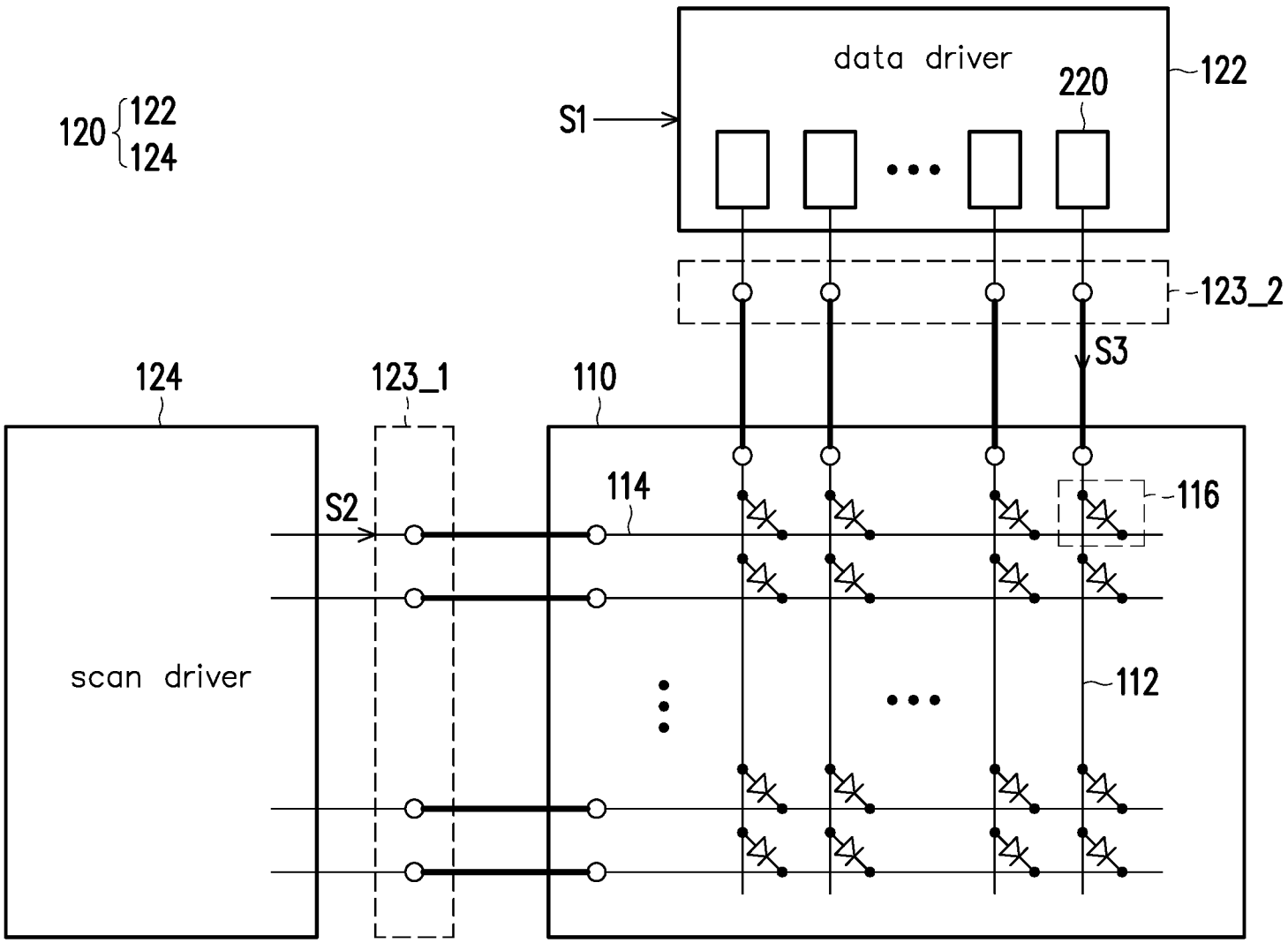
FIG. 2 illustrates a schematic diagram of a display panel and a driver circuit depicted in FIG. 1.

FIG. 1 illustrates a block diagram of a display apparatus according to an embodiment of the invention. FIG. 2 illustrates a schematic diagram of a display panel and a driver circuit depicted in FIG. 1. Referring to FIG. 1 and FIG. 2, the display apparatus 100 of the present embodiment includes a display panel 110, a driver circuit 120 and a control circuit 130. The display panel 110 may be a micro-LED display panel or a mini-LED display panel that includes arrays of microscopic LEDs forming individual pixel elements. The control circuit 130 may be a timing controller or other controllers of the display apparatus 100 for controlling the operation of the display apparatus 100.

To be specific, the display panel 110 includes a plurality of data lines 112, a plurality of scan lines 114 and a plurality of light-emitting diode (LED) devices 126 in the present embodiment. The light-emitting diode devices 126 are connected to the respective data lines 112 and the respective scan lines 114. The light-emitting diode devices 126 are arranged in an array. The control circuit 130 is configured to output a display data S1 to the driver circuit 120. The driver circuit 120 is configured to receive the display data S1 from the control circuit 130 and drive the display panel 110 according to the display data S1.

The driver circuit 120 includes a data driver 122 and a scan driver 124 in the present embodiment. In an embodiment, the data driver 122 and the scan driver 124 may be integrated into a single semiconductor chip, but the invention is not limited thereto. In other embodiments, the data driver 122 and the scan driver 124 may be formed in different semiconductor chips. The scan driver 124 is configured to output scan signals S2 to the scan lines 114 to scan LED rows via respective output terminals 123_1 of the driver circuit 120. In an embodiment, the output terminals 123_1 may be chip pins of the driver circuit 120.

The data driver 122 is configured to output driving signals S3 to the data lines 112 to drive the light-emitting diode devices 116 according to the display data S1. In an embodiment, the driving signals S3 may be currents for driving the light-emitting diode devices 116. The data driver 122 includes a plurality of output channels 220. The output channels 220 outputs the driving signals S3 to the data lines 112 to drive the light-emitting diode devices 116 via respective output terminals 123_1 of the driver circuit 120. In an embodiment, the output terminals 123_2 may be chip pins of the driver circuit 120.

In the present embodiment, the output channels 220 include electrical elements configured to generate the currents for driving the light-emitting diode devices 116, and enough teaching, suggestion, and implementation illustration for the hardware structures of the output channels 220 can be obtained with reference to common knowledge in the related art.

Figure 3:
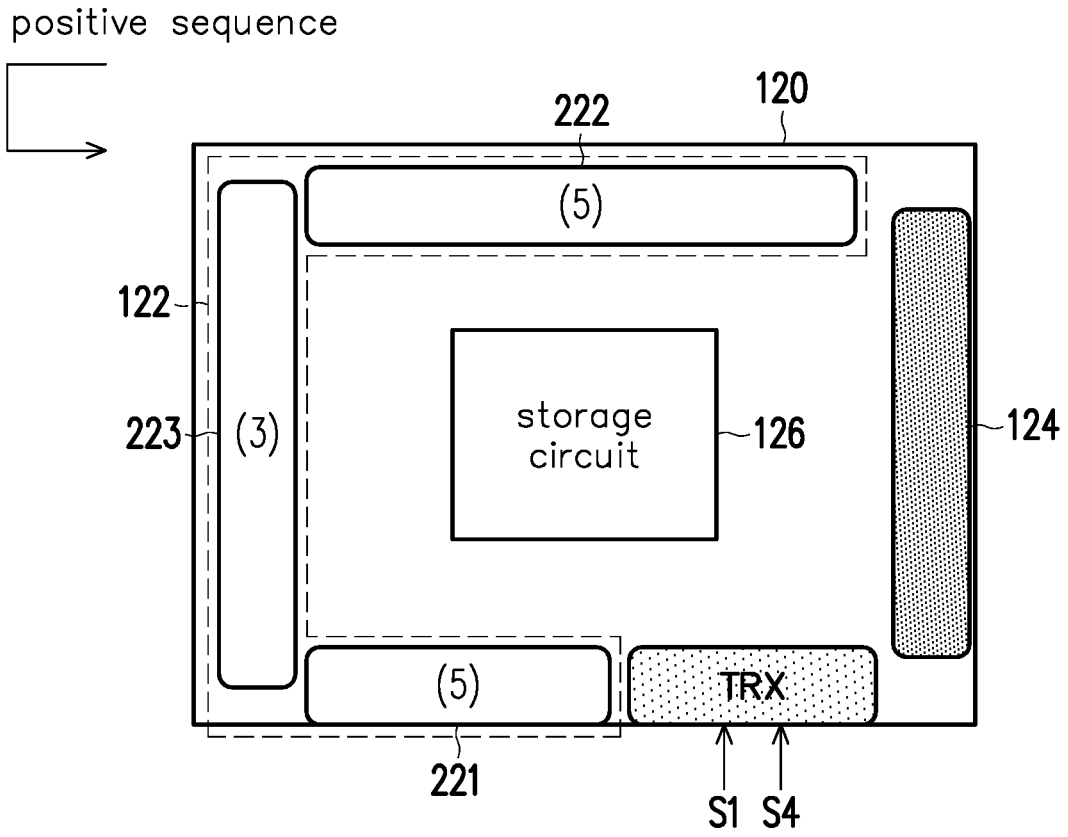
FIG. 3 illustrates a schematic diagram of a driver circuit configured to drive a display panel according to an embodiment of the invention.

FIG. 3 illustrates a schematic diagram of a driver circuit configured to drive a display panel according to an embodiment of the invention. Referring to FIG. 2 and FIG. 3, the driver circuit 120 of the present embodiment is a single semiconductor chip. The output channels 220 of the data driver 122 are grouped into a plurality of channel groups 221, 222 and 223. The channel groups 221, 222 and 223 are disposed in different sides of the driver circuit 120.

The first channel group 221 is the channel group arranged nearest to a transceiver TRX. The transceiver TRX is a device which can transmit and receive signals. In the present embodiment, the transceiver TRX may include a plurality of input and output (I/O) pins of the driver circuit 120 for transmitting and receiving the display data S1 and a control signal S4. The channel groups 221, 222 and 223 may include different numbers of output channels 220 or the same number of output channels 220. For example, the first channel group 221 may include 5 output channels, the second channel group 222 may include 5 output channels, and the third channel group 223 may include 3 output channels in the present embodiment. The number of the output channels included in each of the channel groups does not intend to limit the invention.

In the present embodiment, the data driver 122 can operate in different operation modes according to the control signal S4, and the control circuit 130 outputs the control signal S4 to set the operation mode of the data driver 122. An assignment relationship of the display data S1 and the output channels 220 is different in the different operation modes. The driver circuit 120 further includes a storage circuit 126 configured to store the assignment relationship of the display data S1 and the output channels 220 of the operation modes. In an embodiment, the storage circuit 126 may be a register circuit.

The assignment relationship of the data segments and the channel groups of the different operation modes is listed in Table 1.

TABLE 1

| | Mode 1 | Mode 2 | Mode 3 | Mode 4 | Mode 5 | Mode 6 |
|---|---|---|---|---|---|---|
| D1 | 222 (5) | 222 (5) | 223 (3) | 223 (3) | 221 (5) | 221 (5) |
| D2 | 223 (3) | 221 (5) | 222 (5) | 221 (5) | 222 (5) | 223 (3) |
| D3 | 221 (5) | 223 (3) | 221 (5) | 222 (5) | 223 (3) | 222 (5) |

In the present embodiment, the display data S includes a plurality of data segments D1, D2 and D3 as listed in the first column of Table 1. The data segments D1, D2 and D3 are assigned to the respective channel groups. The data driver 122 has six operation modes Mode 1 to Mode 6. In Table 1, the mark "221 (5)" indicates the first channel group 221 which includes 5 output channels; the mark "222 (5)" indicates the second channel group 222 which includes 5 output channels; and the mark "223 (3)" indicates the third channel group 223 which includes 3 output channels. When the data driver 122 operates in the operation mode Mode 1, the data segments D1, D2 and D3 are respectively assigned to the channel groups 222, 223 and 221 as listed in the second column of Table 1. The assignment relationship of the display data S1 and the output channels 220 of the other operation modes Mode 2 to Mode 6 can be deduced by analog. The assignment relationship indicates the specified data segment of the display data is assigned which channel group of the data driver.

Taking the operation mode Mode 6 for example, the assignment relationship of the display data S1 and the output channels 220 of the operation mode Mode 6 is listed in Table 2.

TABLE 2

| S1 = 1, 2, 3, 4, 5, 6, 7, 8, 9, 10, 11, 12, 13 | | | |
|---|---|---|---|
| Mode 6 | D1 = 1, 2, 3, 4, 5<br>221 (5) | D2 = 6, 7, 8<br>223 (3) | D3 = 9, 10, 11, 12, 13<br>222 (5) |

The display data S1 may include a plurality of pixel data 1 to 13, e.g. digital codes. In the operation mode Mode 6, the data segment D1 includes the pixel data 1, 2, 3, 4, 5, and the pixel data 1, 2, 3, 4, 5 are assigned to the output channels 220 of the first channel group 221 from left to right in a positive sequence (a first sequence). In FIG. 3, the positive sequence is a counterclockwise direction, which starts from the first output channel of the second channel group 222 to the final (the fifth) output channel of the first channel group 221. In an embodiment, the pixel data 1, 2, 3, 4, 5 may be assigned to the output channels 220 of the first channel group 221 from left to right in an inverse sequence (a second sequence). That is, the pixel data 5, 4, 3, 2, 1 are assigned to the output channels 220 of the first channel group 221 from left to right in sequence.

The data segment D2 includes the pixel data 6, 7, 8, and the pixel data 6, 7, 8 are assigned to the output channels 220 of the third channel group 223 from top to bottom in the first sequence. In an embodiment, the pixel data 6, 7, 8 may be assigned to the output channels 220 of the third channel group 223 from top to bottom in the second sequence. The first sequence and the second sequence are inverse sequences. That is, the pixel data 8, 7, 6 are assigned to the output channels 220 of the third channel group 223 from top to bottom in sequence.

The data segment D3 includes the pixel data 9, 10, 11, 12, 13, and the pixel data 9, 10, 11, 12, 13 are assigned to the output channels 220 of the second channel group 222 from right to left in the first sequence. In an embodiment, the pixel data 9, 10, 11, 12, 13 may be assigned to the output channels 220 of the third channel group 223 from right to left in the second sequence. That is, the pixel data 13, 12, 11, 10, 9 are assigned to the output channels 220 of the third channel group 223 from right to left in sequence.

Taking the operation mode Mode 3 for another example, the assignment relationship of the display data S1 and the output channels 220 of the operation mode Mode 3 is listed in Table 3.

TABLE 3

| S1 = 1, 2, 3, 4, 5, 6, 7, 8, 9, 10, 11, 12, 13 | | | |
|---|---|---|---|
| Mode 3 | D1 = 1, 2, 3<br>223 (3) | D2 = 4, 5 6, 7, 8<br>222 (5) | D3 = 9, 10, 11, 12, 13<br>221 (5) |

In the operation mode Mode 3, the data segment D1 includes the pixel data 1, 2, 3, and the pixel data 1, 2, 3 are assigned to the output channels 220 of the third channel group 223 from top to bottom in the first sequence. In an embodiment, the pixel data 1, 2, 3 may be assigned to the output channels 220 of the third channel group 223 from top to bottom in the second sequence. That is, the pixel data 3, 2, 1 are assigned to the output channels 220 of the third channel group 223 from top to bottom in sequence.

The data segment D2 includes the pixel data 4, 5, 6, 7, 8, and the pixel data 4, 5, 6, 7, 8 are assigned to the output channels 220 of the second channel group 222 from right to left in the first sequence. In an embodiment, the pixel data 4, 5, 6, 7, 8 may be assigned to the output channels 220 of the second channel group 222 from right to left in the second sequence. That is, the pixel data 8, 7, 6, 5, 4 are assigned to the output channels 220 of the second channel group 222 from right to left in sequence.

The data segment D3 includes the pixel data 9, 10, 11, 12, 13, and the pixel data 9, 10, 11, 12, 13 are assigned to the output channels 220 of the first channel group 221 from left to right in the first sequence. In an embodiment, the pixel data 9, 10, 11, 12, 13 may be assigned to the output channels 220 of the first channel group 221 from left to right in the second sequence. That is, the pixel data 13, 12, 11, 10, 9 are assigned to the output channels 220 of the first channel group 221 from left to right in sequence.

The assignment relationship of the display data S1 and the output channels 220 of the other operation modes Mode 1, Mode 2, Mode 4 and Mode 5 can be deduced by analogy, and it will not be repeated herein.

Therefore, in the present embodiment, the storage circuit 126 stores the assignment relationship of the display data S1 and the output channels 220 of the operation modes, and the control circuit 130 outputs the control signal S4 to set the operation mode of the data driver 122. The data driver 122 can operate in the different operation modes according to the control signal S4. The pixel data of the display data S1 are assigned to the respective channel groups in a first sequence or in a second sequence according to the control signal S4, where the first sequence and the second sequence are inverse sequences.

Figure 4:
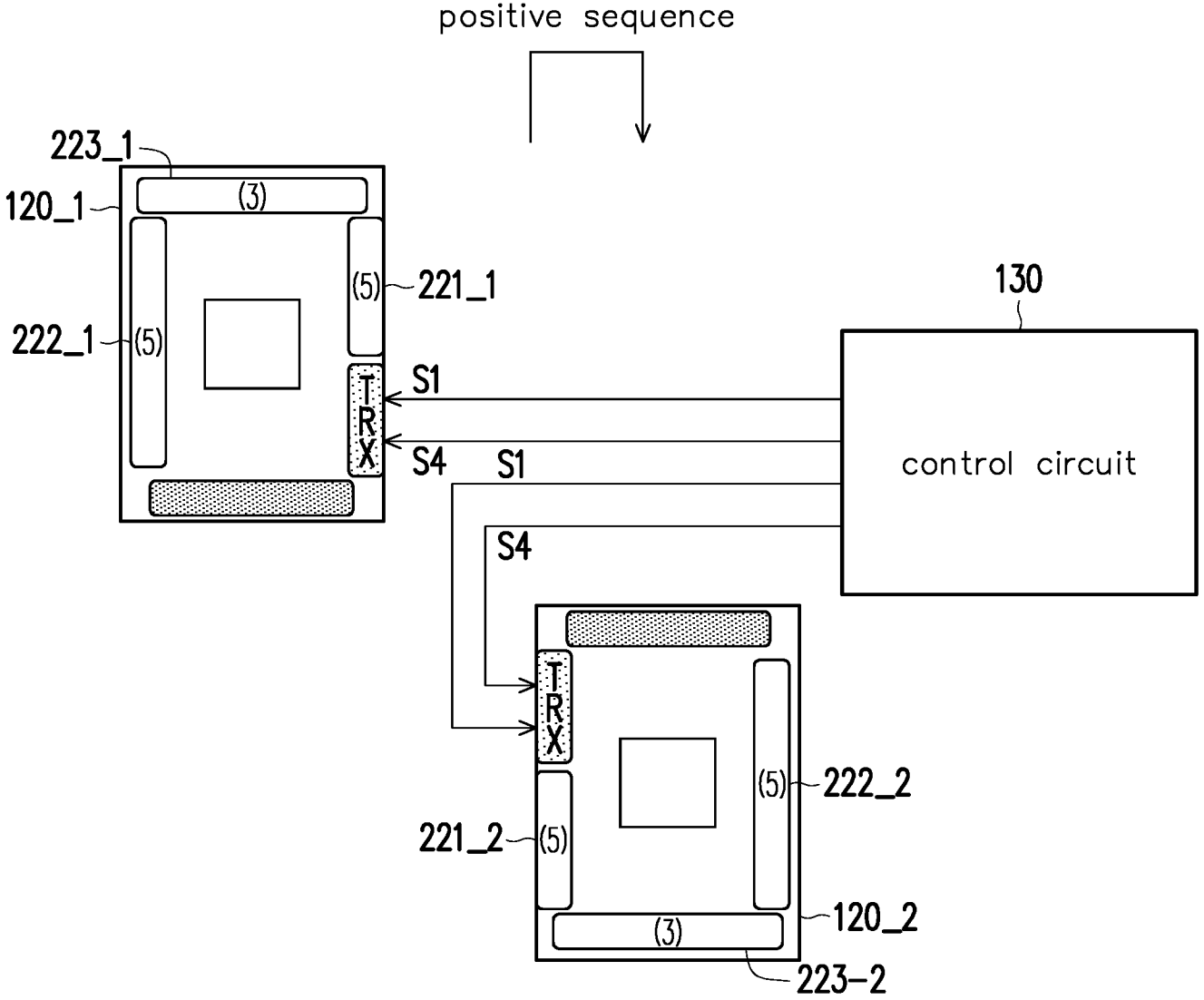
FIG. 4 illustrates a schematic diagram of driver circuits configured to drive display panels according to an embodiment of the invention.

FIG. 4 illustrates a schematic diagram of driver circuits configured to drive display panels according to an embodiment of the invention. Referring to FIG. 4, the driver circuits 120_1 and 120_2 are configured to drive the same or different display panels. The control circuit 130 outputs the control signal S4 to set the operation modes of the driver circuits 120_1 and 120_2.

The assignment relationship of the display data S1 and the channel groups of the set operation mode is listed in Table 4.

TABLE 4

| driver circuits | display data | channel groups | assignment sequence |
|---|---|---|---|
| 120_1 | P1-P3 | 223_1 (3) | inverse sequence |
| | P4-P8 | 221_1 (5) | positive sequence |
| | P9-P13 | 222_1 (5) | inverse sequence |
| 120_2 | P14-P18 | 222_2 (5) | positive sequence |
| | P19-P23 | 221_2 (5) | inverse sequence |
| | P24-P26 | 223_2 (3) | positive sequence |

In the present embodiment, the display data S1 includes pixel data P1 to P26 assigned to 26 output channels of the driver circuits 120_1 and 120_2. The pixel data P1 to P13 is assigned to 13 output channels of the driver circuits 120_1, and the pixel data P14 to P26 is assigned to 13 output channels of the driver circuits 120_2. In the present embodiment, the driver circuits 120_1 and 120_2 are respectively set to different operation modes by the control signal S4 from the control circuit 130.

In FIG. 4, the positive sequence of the driver circuit 120_1 is a clockwise direction, which starts from the first output channel of the second channel group 222_1 to the final (the fifth) output channel of the first channel group 221_1, and the positive sequence of the driver circuit 120_2 is also a clockwise direction, which starts from the first output channel of the second channel group 222_2 to the final (the fifth) output channel of the first channel group 221_2.

Figure 5:
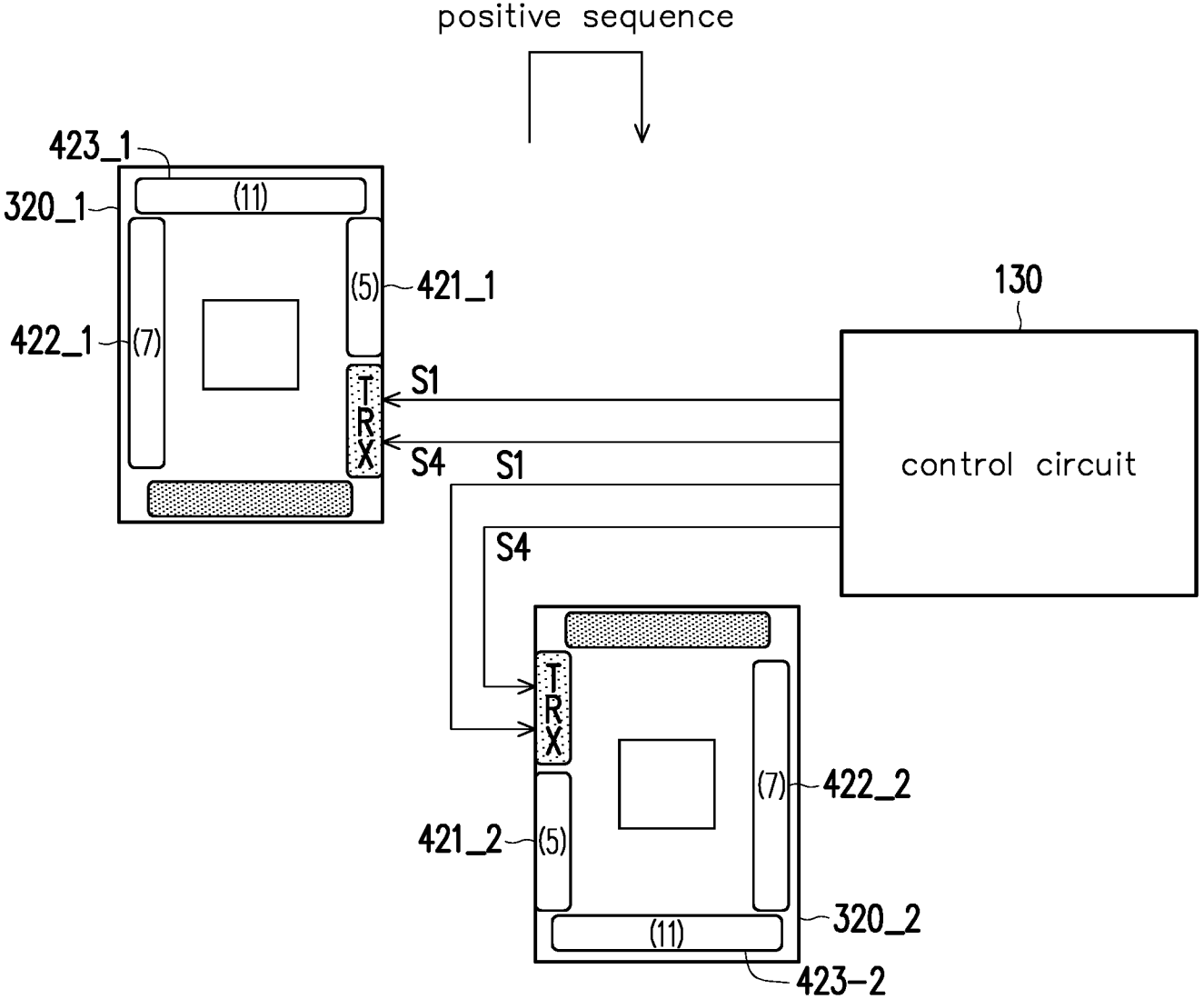
FIG. 5 illustrates a schematic diagram of driver circuits configured to drive display panels according to an embodiment of the invention.

FIG. 5 illustrates a schematic diagram of driver circuits configured to drive display panels according to an embodiment of the invention. Referring to FIG. 5, the driver circuits 320_1 and 320_2 are configured to drive the same or different display panels. The control circuit 130 outputs the control signal S4 to set the operation modes of the driver circuits 320_1 and 320_2. In the present embodiment, the driver circuits 320_1 and 320_2 are respectively set to different operation modes by the control signal S4 from the control circuit 130.

The assignment relationship of the display data S1 and the channel groups of the set operation mode is listed in Table 5.

TABLE 5

| driver circuits | display data | channel groups | assignment sequence |
|---|---|---|---|
| 320_1 | P1-P11 | 423_1 (11) | inverse sequence |
| | P12-P16 | 421_1 (5) | positive sequence |
| | P17-P23 | 422_1 (7) | inverse sequence |
| 320_2 | P24-P30 | 422_2 (7) | positive sequence |
| | P31-P34 | 421_2 (4) | inverse sequence |
| | P35-P45 | 423_2 (11) | positive sequence |

In the present embodiment, the first channel groups 421_1 and 421_2 respectively include 5 output channels; the second channel groups 422_1 and 422_2 respectively include 7 output channels; and the third channel groups 423_1 and 423_2 respectively include 11 output channels. The display data S1 includes pixel data P1 to P45 assigned to 45 output channels of the driver circuits 120_1 and 120_2. The pixel data P1 to P23 is assigned to 23 output channels of the driver circuits 120_1, and the pixel data P24 to P45 is assigned to 22 output channels of the driver circuits 120_2.

In the present embodiment, the mark "421_2 (4)" in the third column indicates the first channel group 421_2 of the driver circuit 320_2 includes 5 output channels but only 4 output channels are activated for receiving the pixel data P31-P34 and outputting the driving signals S2 according to the control signal S4. In other words, a specified channel number of the first channel group 421_2 is activated to output the driving signals S2 according to the control signal S4. The specified channel number is adjustable and equal to or smaller than the total channel number of the first channel group 421_2. That is to say, in an embodiment, 1, 2, 3 or 5 output channels may be activated for driving operation.

In addition, a constant channel number of the second channel group 422_2 and the third channel group 422_3 of the driver circuit 320_2 is activated to output the driving signals S2, where the constant channel number is equal to the total channel number of the second channel group 422_2 and the third channel group 422_3. For example, the second channel group 422_2 and the third channel group 423_2 respectively include 7 output channels and 11 output channels, and all of the output channels of the second channel group 422_2 and the third channel group 422_3 is activated for driving operation.

In FIG. 5, the positive sequence of the driver circuit 320_1 is a clockwise direction, which starts from the first output channel of the second channel group 422_1 to the final (the fifth) output channel of the first channel group 421_1, and the positive sequence of the driver circuit 320_2 is also a clockwise direction, which starts from the first output channel of the second channel group 422_2 to the final (the fifth) output channel of the first channel group 421_2.

Figure 6:
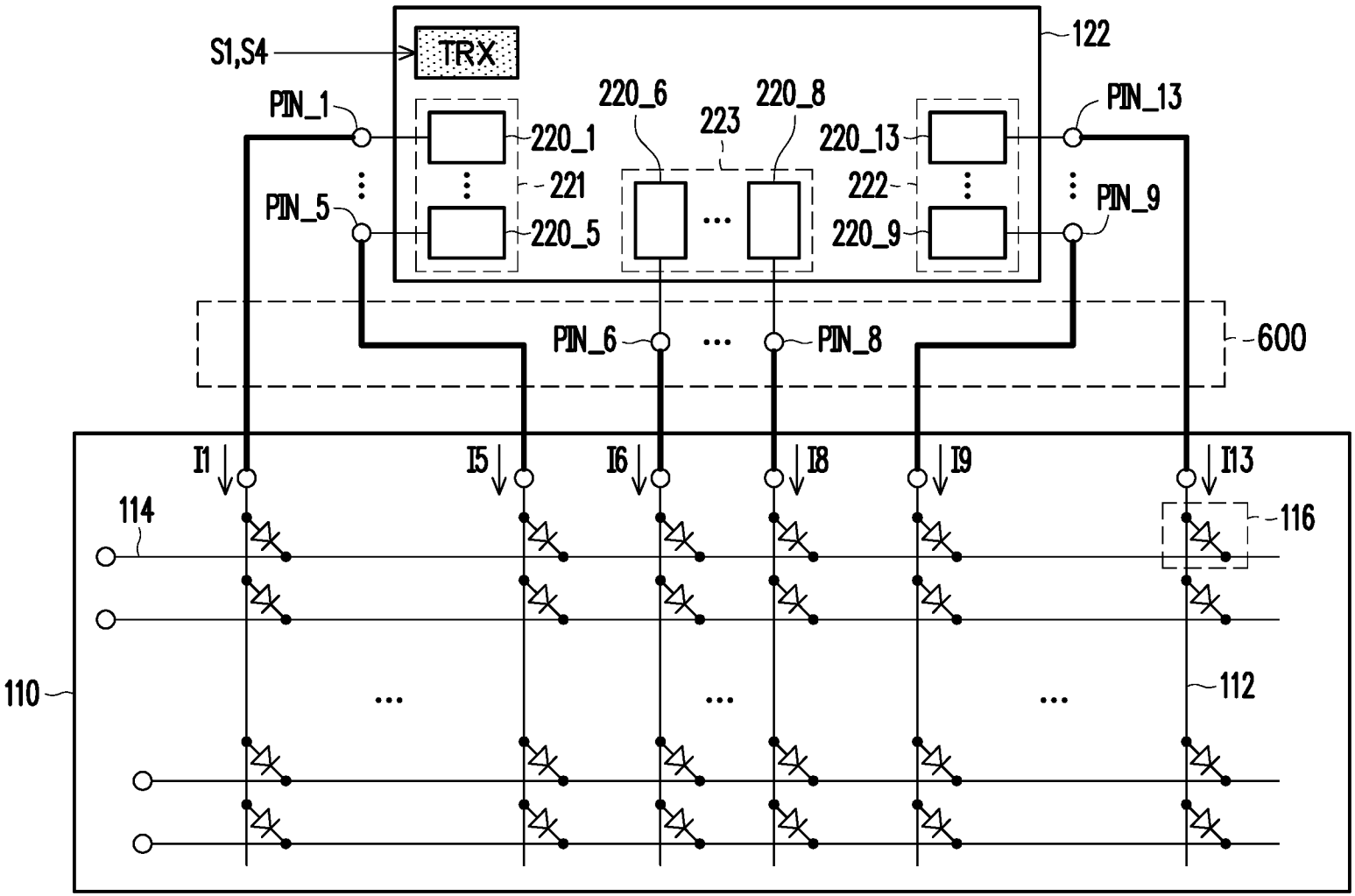
FIG. 6 illustrates a schematic diagram of a data driver configured to drive a display panel and a wiring structure therebetween according to an embodiment of the invention.

FIG. 6 illustrates a schematic diagram of a data driver configured to drive a display panel and a wiring structure therebetween according to an embodiment of the invention. Referring to FIG. 6, the data driver 122 of the present embodiment receive the display data S1 and generate the driving signals I1 to I13 according to the display data S1. The data driver 122 includes 13 output channels 220_1 to 220_13, and the output channels 220_1 to 220_13 respectively output driving signals I1 to I13 to drive corresponding LED columns. The control circuit 130 outputs the control signal S4 to set the data driver 122 to operate in the operation mode Mode 6, and the assignment relationship of the display data S1 and the output channels 220_1 to 220_13 follows the setting of the operation mode Mode 6 that listed in Table 2.

Figure 7:
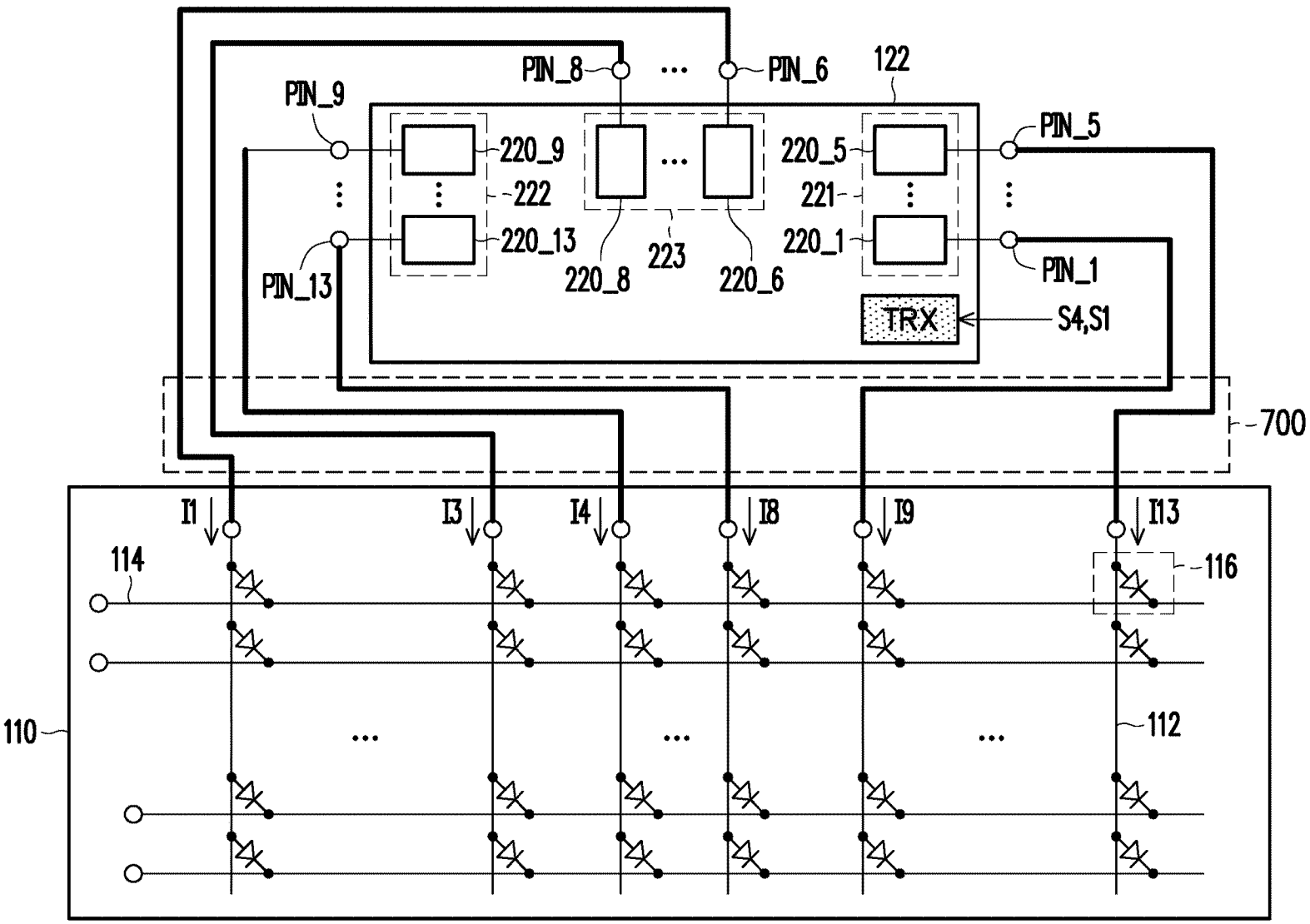
FIG. 7 illustrates a schematic diagram of a data driver configured to drive a display panel and a wiring structure therebetween according to another embodiment of the invention.

FIG. 7 illustrates a schematic diagram of a data driver configured to drive a display panel and a wiring structure therebetween according to another embodiment of the invention. Referring to FIG. 7, the data driver 122 is rotated by 180 degrees and connected to the display panel 120. The control circuit 130 outputs the control signal S4 to set the data driver 122 to operate in the operation mode Mode 3, and the assignment relationship of the display data S1 and the output channels 220_1 to 220_13 follows the setting of the operation mode Mode 3 that listed in Table 3.

In the embodiments of FIG. 6 and FIG. 7, since the assignment relationship of the display data S1 and the output channels 220_1 to 220_13 can be flexibly adjusted according to the operation modes of the data driver 122, the wiring structures 600 and 700 between the data driver 122 and the display panel 120 are simple. The wiring structures 600 and 700 may be implemented in a single layer, and jumper wires are unnecessary in the wiring structures 600 and 700.

Figure 8:
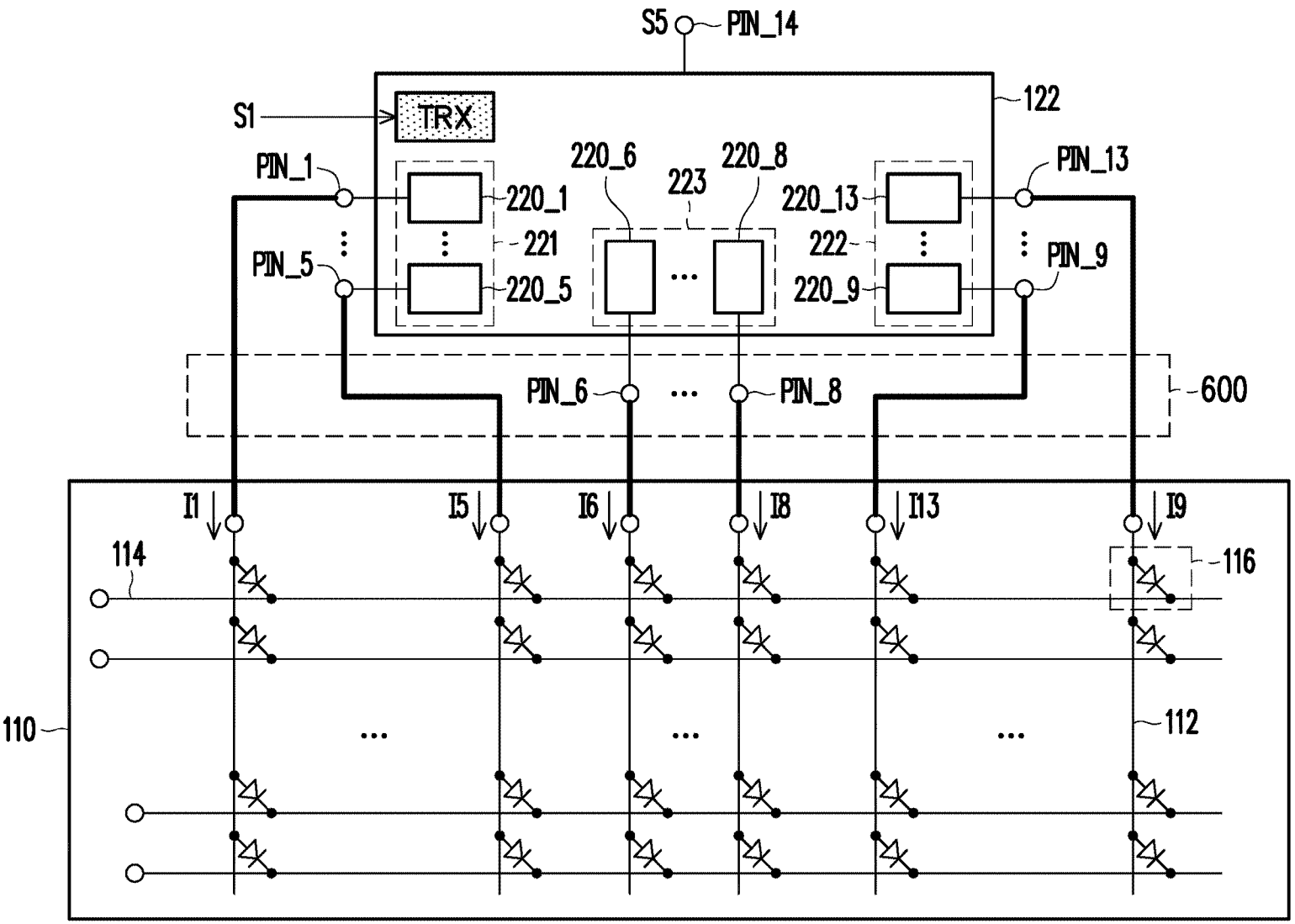
FIG. 8 illustrates a schematic diagram of a data driver configured to drive a display panel and a wiring structure therebetween according to an embodiment of the invention.

FIG. 8 illustrates a schematic diagram of a data driver configured to drive a display panel and a wiring structure therebetween according to an embodiment of the invention. Referring to FIG. 6 and FIG. 8, in FIG. 6, the pixel data corresponding to the driving signals I9 to I13 is assigned to the output channels 220_9 to 220_13 of the channel group 222 in a first sequence, i.e. from bottom to top. By contrast, in FIG. 8, the pixel data corresponding to the driving signals I9 to I13 is assigned to the output channels 220_9 to 220_13 of the channel group 222 in a second sequence, i.e. from top to bottom, according to a first selection signal S5 from a hardware input terminal PIN_14 of the data driver 122. That is to say, the pixel data is assigned to the channel group 222 in the first sequence or in the second sequence according to the first selection signal S5 from an input terminals of the driver circuit, and the first sequence and the second sequence are inverse sequences. The control circuit 130 may output the first selection signal S5 to the data driver 122 to set the assignment sequence.

Figure 9:
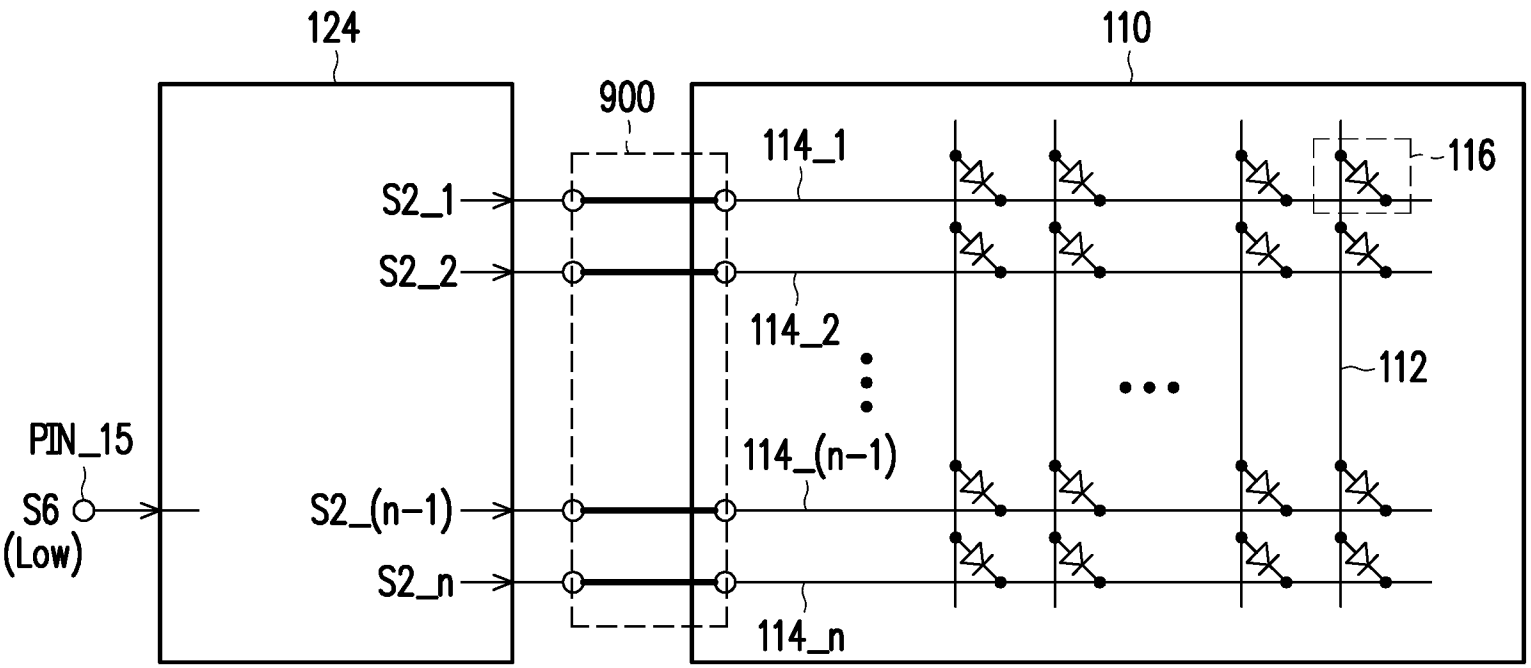
FIG. 9 illustrates a schematic diagram of a scan driver configured to drive a display panel and a wiring structure therebetween according to an embodiment of the invention.

FIG. 9 illustrates a schematic diagram of a scan driver configured to drive a display panel and a wiring structure therebetween according to an embodiment of the invention. Referring to FIG. 9, the scan driver 124 respectively outputs scan signals S2_1, S2_2 to S2_($n$−1) and S2_$n$ to the scan lines 114_1, 114_2 to 114_($n$−1) and 114_$n$ according to a second selection signal S6 of a low level, where n is a positive integer larger than 2. The second selection signal S6 is inputted to the scan driver 124 via a hardware input terminal PIN_15. The scan driver 124 scans lines of the light-emitting diode devices 116 in a positive sequence (a third sequence), i.e. from top to bottom. The control circuit 130 may output the second selection signal S6 to the scan driver 124 to set the scan sequence of the scan lines 114_1, 114_2 to 114_($n$−1) and 114_$n$.

Figure 10:
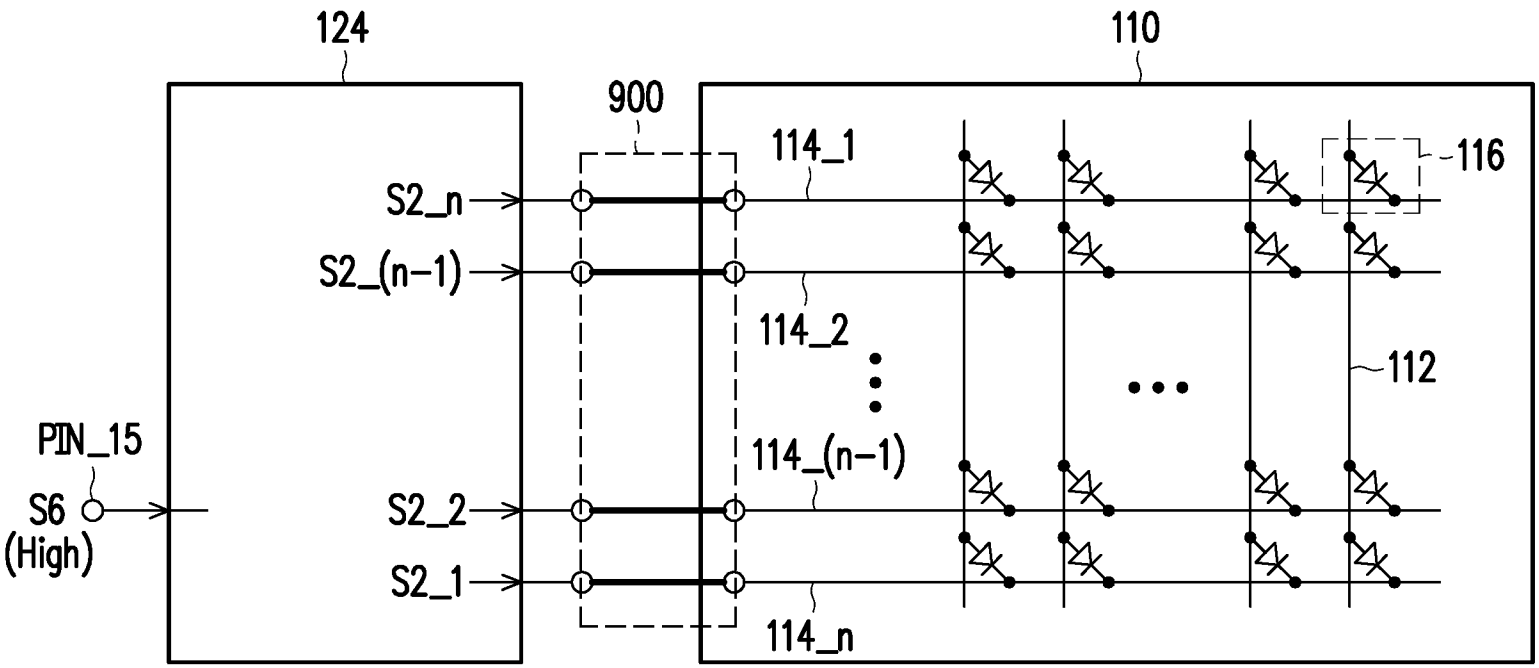
FIG. 10 illustrates a schematic diagram of a scan driver configured to drive a display panel and a wiring structure therebetween according to another embodiment of the invention.

FIG. 10 illustrates a schematic diagram of a scan driver configured to drive a display panel and a wiring structure therebetween according to another embodiment of the invention. Referring to FIG. 10, the scan driver 124 respectively outputs scan signals S2_$n$, S2_($n$−1) to S2_2 and S2_1 to the scan lines 114_1, 114_2 to 114_($n$−1) and 114_$n$ according to the second selection signal S6 of a high level. The scan driver 124 scans lines of the light-emitting diode devices 116 in an inverse sequence (a fourth sequence), i.e. from bottom to top.

In the embodiments of FIG. 9 and FIG. 10, since the scan sequence of the scan sequence of the scan lines 114_1, 114_2 to 114_($n$−1) and 114_$n$ can be flexibly adjusted according to the second selection signal S6, the wiring structure 900 between the scan driver 124 and the display panel 120 is simple. The wiring structure 900 may be implemented in a single layer, and jumper wires are unnecessary in the wiring structure 900.

In summary, in the embodiments of the invention, the assignment relationship of the display data and the output channels is different in different operation modes. The driver circuit can be set to operate in the different operation modes, and thus the data assignment can be flexibly adjusted. Therefore, even if the output pins of the driver circuit are not consistent with the arrangement of the display panel, the wire structure between the driver circuit and the display panel can still be simplified.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display apparatus, comprising:

a display panel comprising a plurality of data lines and a plurality of light-emitting diode devices connected to the data lines; and a driver circuit configured to receive a display data and drive the display panel according to the display data, wherein the driver circuit comprises:

a data driver configured to output driving signals to the data lines to drive the light-emitting diode devices according to the display data and operate in different operation modes according to a control signal, and comprising a plurality of output channels, wherein the plurality of output channels are grouped into a plurality of channel groups, wherein the output channels output the driving signals to the data lines to drive the light-emitting diode devices via respective output terminals of the driver circuit, and an assignment relationship of the display data and the channel groups is different in the different operation modes.

2. The display apparatus of claim 1, wherein the channel groups are disposed in different sides of the driver circuit.

3. The display apparatus of claim 2, wherein the channel groups comprise a first channel group, a specified channel number of the first channel group is activated to output the driving signals according to the control signal, and the specified channel number is adjustable and equal to or smaller than a total channel number of the first channel group.

4. The display apparatus of claim 3, wherein the channel groups comprise a second channel group and a third channel group, a constant channel number of the second channel group and the third channel group is activated to output the driving signals, and the constant channel number is equal to a total channel number of the second channel group and the third channel group.

5. The display apparatus of claim 2, wherein the display data comprises a plurality of data segments, the data segments are assigned to the respective channel groups, and each of the data segments comprises a plurality of pixel data, wherein the pixel data is assigned to the channel group in a first sequence or in a second sequence according to the control signal, and the first sequence and the second sequence are inverse sequences.

6. The display apparatus of claim 2, wherein the display data comprises a plurality of data segments, the data segments are assigned to the respective channel groups, and each of the data segments comprises a plurality of pixel data, wherein the pixel data is assigned to the channel group in a first sequence or in a second sequence according to a first selection signal from an input terminal of the driver circuit, and the first sequence and the second sequence are inverse sequences.

7. The display apparatus of claim 1, wherein the driver circuit further comprises:

a storage circuit configured to store the assignment relationship of the display data and the channel groups of the different operation modes.

8. The display apparatus of claim 1, wherein the display panel further comprises a plurality of scan lines connected to the light-emitting diode devices, and the driver circuit further comprises:

a scan driver configured to output scan signals to the scan lines to scan lines of the light-emitting diode devices in a third sequence or in a fourth sequence according to a second selection signal from an input terminal of the driver circuit, wherein the third sequence and the fourth sequence are inverse sequences.

9. The display apparatus of claim 1, further comprising:

a control circuit configured to output the display data to the driver circuit and output the control signal to set the operation mode of the driver circuit.

10. A driver circuit configured to receive a display data and drive a display panel comprising a plurality of light-emitting diode devices according to the display data, and the driver circuit comprising:

a data driver configured to output driving signals to drive the light-emitting diode devices according to the display data and operate in different operation modes according to a control signal, and comprising a plurality of output channels, wherein the plurality of output channels are grouped into a plurality of channel groups, wherein the output channels output the driving signals to drive the light-emitting diode devices via respective output terminals of the driver circuit, and an assignment relationship of the display data and the channel groups is different in the different operation modes.

11. The driver circuit of claim 10, wherein the channel groups are disposed in different sides of the driver circuit.

12. The driver circuit of claim 11, wherein the channel groups comprise a first channel group, a specified channel number of the first channel group is activated to output the driving signals according to the control signal, and the specified channel number is adjustable and equal to or smaller than a total channel number of the first channel group.

13. The driver circuit of claim 12, wherein the channel groups comprise a second channel group and a third channel group, a constant channel number of the second channel group and the third channel group is activated to output the driving signals, and the constant channel number is equal to a total channel number of the second channel group and the third channel group.

14. The driver circuit of claim 11, wherein the display data comprises a plurality of data segments, the data segments are assigned to the respective channel groups, and each of the data segments comprises a plurality of pixel data, wherein the pixel data is assigned to the channel group in a first sequence or in a second sequence according to the control signal, and the first sequence and the second sequence are inverse sequences.

15. The driver circuit of claim 11, wherein the display data comprises a plurality of data segments, the data segments are assigned to the respective channel groups, and each of the data segments comprises a plurality of pixel data, wherein the pixel data is assigned to the channel group in a first sequence or in a second sequence according to a first selection signal from an input terminal of the driver circuit, and the first sequence and the second sequence are inverse sequences.

16. The driver circuit of claim 10, further comprising:

a storage circuit configured to store the assignment relationship of the display data and the channel groups of the different operation modes.

17. The driver circuit of claim 10, further comprising:

a scan driver configured to output scan signals to scan lines of the light-emitting diode devices in a third sequence or in a fourth sequence according to a second selection signal from an input terminal of the driver circuit, wherein the third sequence and the fourth sequence are inverse sequences.

* * * * *